US007293969B2

(12) United States Patent
Midorikawa

(10) Patent No.: US 7,293,969 B2
(45) Date of Patent: Nov. 13, 2007

(54) TIP SEAL IN A SCROLL FLUID MACHINE

(75) Inventor: Youhei Midorikawa, Tokyo (JP)

(73) Assignee: Anest Iwata Corporation (JP)

( * ) Notice: Subject to any disclaimer, the term of this patent is extended or adjusted under 35 U.S.C. 154(b) by 0 days.

(21) Appl. No.: 11/464,576

(22) Filed: Aug. 15, 2006

(65) Prior Publication Data

US 2007/0048163 A1 Mar. 1, 2007

(30) Foreign Application Priority Data

Aug. 24, 2005 (JP) ..... 2005-243179

(51) Int. Cl.
*F04C 18/00* (2006.01)

(52) U.S. Cl. ..... 418/55.4; 418/55.1; 418/142

(58) Field of Classification Search ..... 418/55.1, 418/55.2, 55.4, 142, 178, 179
See application file for complete search history.

(56) References Cited

U.S. PATENT DOCUMENTS 6,068,459 A * 5/2000 Clarke et al. ..... 418/55.4
7,195,469 B2 * 3/2007 Tsuchiya et al. ..... 418/55.4
2007/0071626 A1 * 3/2007 Tsuchiya et al. ..... 418/55.4

FOREIGN PATENT DOCUMENTS

| | | | |
|---|---|---|---|
| JP | 3248618 B | | 11/1991 |
| JP | 6207588 A | | 7/1994 |
| JP | 08100776 A | * | 4/1996 |
| JP | 09250467 A | * | 9/1997 |

* cited by examiner

*Primary Examiner*—Theresa Trieu

(57) ABSTRACT

A scroll fluid machine comprises a stationary scroll having a stationary wrap and an orbiting scroll having an orbiting wrap. A tip seal is provided in a tip-seal groove at the ends of the stationary and orbiting wraps to allow the stationary wrap to engage with the orbiting wrap slidably. The tip seal comprises a sealing material in the tip-seal groove and a backup material between the sealing material and the bottom of the tip-seal groove. The tip seal tightly contact the backup material without an adhesive to keep their sideward positional relationship exact.

2 Claims, 4 Drawing Sheets

TIP SEAL IN A SCROLL FLUID MACHINE

BACKGROUND OF THE INVENTION

The present invention relates to a tip seal in a scroll fluid machine and particularly to a tip seal that fits in a tip-seal groove on the end faces of an orbiting wrap and a stationary wrap.

A scroll fluid machine such as a scroll compressor and a scroll vacuum pump comprises a drive shaft having an eccentric axial portion at one end; an orbiting scroll pivotally connected on the eccentric axial portion via a bearing and having an orbiting wrap on an orbiting end plate; a stationary scroll having a stationary wrap on stationary end plate; and a plurality of self-rotation preventing devices for preventing the orbiting scroll from rotating on its own axis. With engagement of the stationary wrap with the orbiting wrap, a sealed chamber is formed between them.

With the self-rotation preventing devices and eccentric axial portion, the orbiting scroll is eccentrically revolved, so that the volume in the sealed chamber gradually decreases toward the center or gradually increases away from the center thereby guiding a gas sucked from the outer circumference with compression or a gas sucked from the center with decompression.

The orbiting and stationary wraps are made based on an involute curve gradually increasing in diameter in a direction of rotation, a curve which comprises connected short arcs in a circumferential direction around the center or combination thereof. A gap in a radial direction between the orbiting and stationary wraps is exactly determined not to contact the wraps to each other or not to be too large.

A tip seal groove is formed on the end faces of the orbiting and stationary scrolls and a tip seal fits in a tip-seal groove to allow the facing ends to slide hermetically.

In order to make sealing capability better between the end plates, a backup material is put on the bottom of the tip-seal groove. A sealing material made of resin is bonded on the backup material with adhesive.

JP6-207588A discloses heat-resistant elastic material in FIG. 3 and JP3248618B discloses porous material softer than sealing material or a band-shaped elastic material made of heat-resistant rubber.

When a scroll fluid machine is used under high temperature or high radioactivity, adhesive between the backup material and sealing material changes in quality or deteriorates to lose adhesive force and to become powder which invades each sliding part thereby decreasing sealing capability and leaking to the outside which results in environmental contamination.

In the backup material bonded to the sealing material, if one of them is not suitable in use, both the materials have to be replaced or abandoned which is not economical.

It will be useful if the backup material and sealing material fit in the tip-seal groove at the ends of the ordinary or stationary wraps to achieve desired function without bonding the backup material to the sealing material.

However, if both are not integrally bonded, sealing capability is not completely kept in bonding surfaces, so that required gas-tightness cannot be achieved.

Furthermore, if the backup material is not integrally connected to the sealing material, it will not be easy to keep their sideward relationship exact to cause troublesome assembling and/or disassembling of them into and/or from the tip-seal groove before and after engagement into the tip-seal groove since they have a small cross-section and are long.

SUMMARY OF THE INVENTION

In view of the disadvantages, it is an object of the invention to provide a tip seal in a scroll fluid machine having a stationary scroll having a stationary wrap and an orbiting scroll having an orbiting wrap, the end of the stationary and/or orbiting wraps having a tip-seal groove, said tip seal comprising a sealing material and a backup material which fit in the tip-seal groove to enable the sideward positional relationship of the sealing and backup materials to be kept exact without an adhesive which likely deteriorates or is powdered under high temperature or radioactivity to make its handling more convenient to allow only unsuitable one to be replaced with a new one by separating them thereby achieving economical and long-time use.

BRIEF DESCRIPTION OF THE DRAWINGS

The features and advantages of the present invention will become more apparent from the following description with respect to embodiments as shown in accompanying drawings wherein.

DETAILED DESCRIPTION OF PREFERRED EMBODIMENTS

Figure 1:
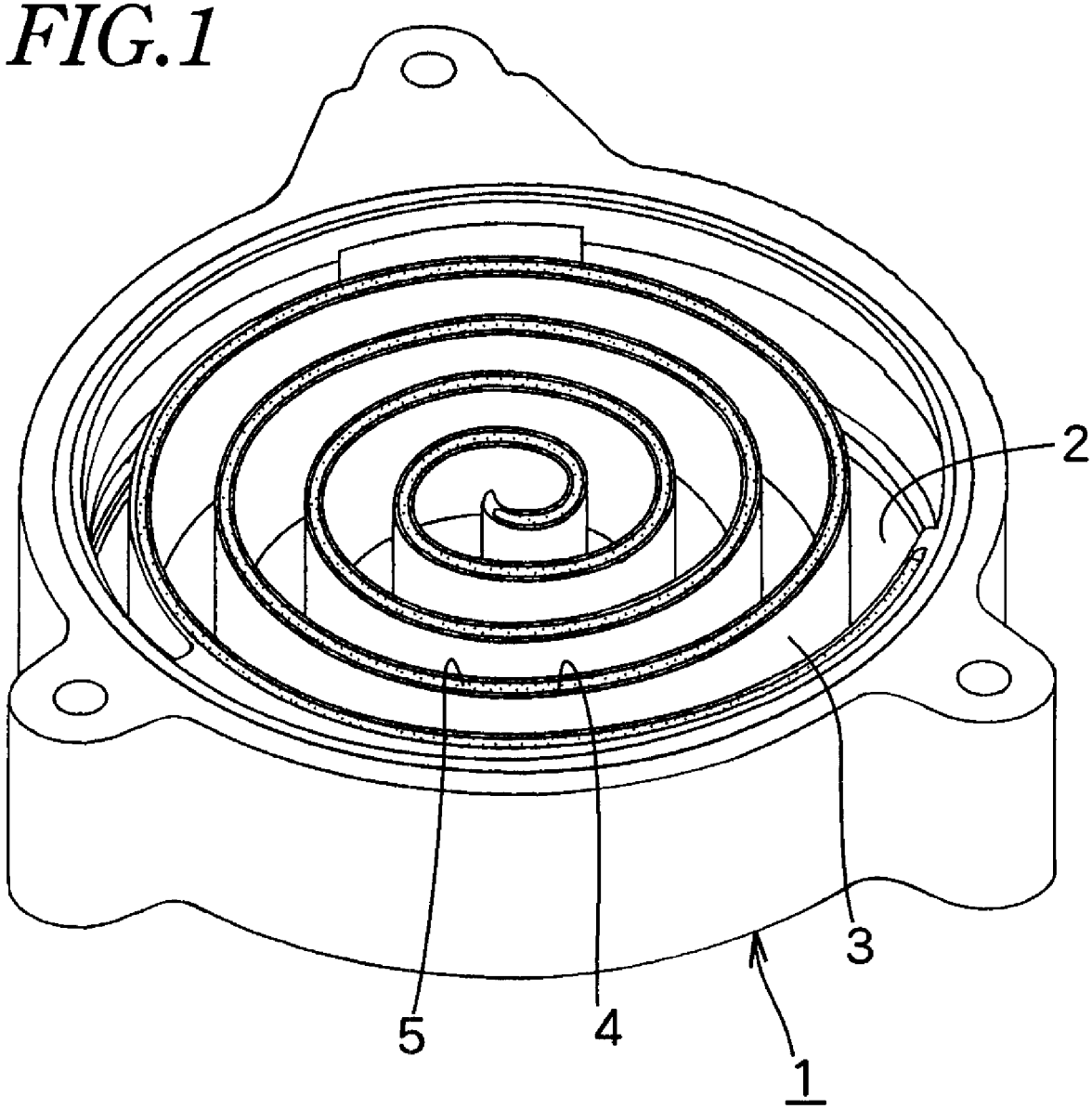
FIG. 1 is a perspective view of a stationary scroll in a scroll fluid machine.

FIG. 1 is a perspective view showing an orbiting scroll 1 on which a tip seal according to the present invention is applied. The tip seal 5 fits in a tip-seal groove 4 on the front end of a spiral orbiting wrap 3 which stands on an end plate 2.

Similar structure appears on a stationary scroll which is not driven by power, and is not shown in the drawings.

Figure 2:
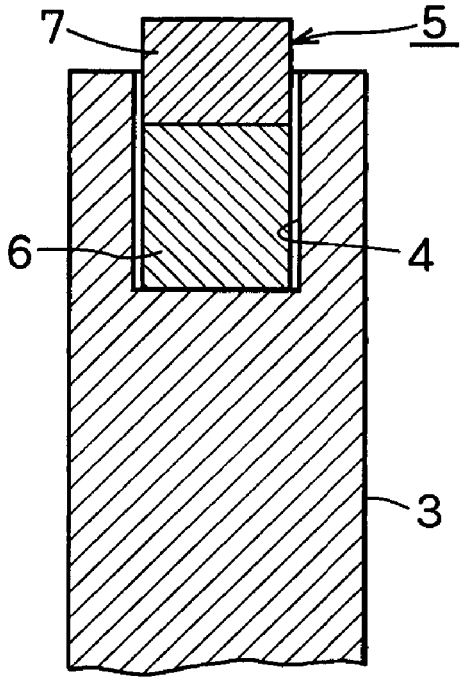
FIG. 2 is an enlarged vertical sectional view of the first embodiment of a tip seal according to the present invention.

FIG. 2 is an enlarged vertical sectional view of the end of the tip-seal groove 4 in which the tip seal 5 according to the present invention fits.

The tip seal 5 comprises a sealing material 7 made of polyimide resin which is overlapped on a backup material 6 which is made of gas-containing sintered carbon and fits on the bottom of the tip-seal groove 4.

The gas-containing sintered carbon comprises "PERMAFOIL", Japanese Registered Trademark, made by Toyo Tanso Co., Ltd. of 5-7-12, Takeshima, Nishiyodogawa-ku, Osaka, Japan by expansion rolling from natural scale-like graphite to reduce foreign substance significantly to have thermal anisotropy thereby providing better flexibility, compressive restoration and compatibility with material other than general graphite.

The carbon is not limited to the above products of Toyo Tanso and may be different material so far as it provides net-like small spaces, flexibility, compressibility and compatibility with counter material.

Figure 3:
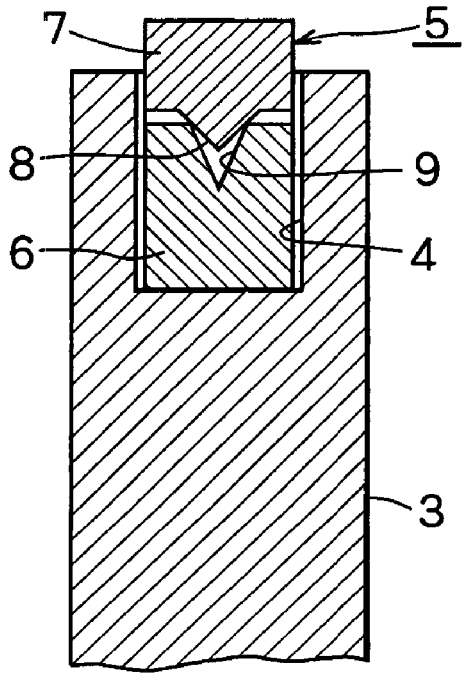
FIG. 3 is an enlarged vertical sectional view of the second embodiment of a tip seal according to the present invention.

FIG. 3 is an enlarged vertical sectional view of the second embodiment of the present invention, in which a tip seal 5 fits in a tip-seal groove 4.

An engagement projection 8 having a V-like cross-section is formed on the bottom of a sealing material 7 and an engagement groove 9 having a V-like cross section more acute than that of the engagement projection 8 is formed in a backup material 6. The engagement projection 8 and groove 9 are not limited to a V-section, but may be curved.

The sealing material 7 is overlapped on the backup material 6 to allow the engagement projection 8 to fit in the engagement groove 9 keeping the relationship of them exact automatically.

The backup material 6 may be made of similar material to that in FIG. 2.

The sealing material 7 is strongly pressed on the backup material 6, so that the inclined surface of the engagement projection 8 is pressed on the opening edge of the engagement groove 9 thereby hindering sideward flow of a gas.

The sealing material is strongly pressed on the backup material 6, so that the engagement projection 8 fits in the engagement groove 9 of the backup material 6 to allow the backup material 6 to bend towards the bottom thereby enabling the seal material 7 to press the counter end plate.

Figure 4:
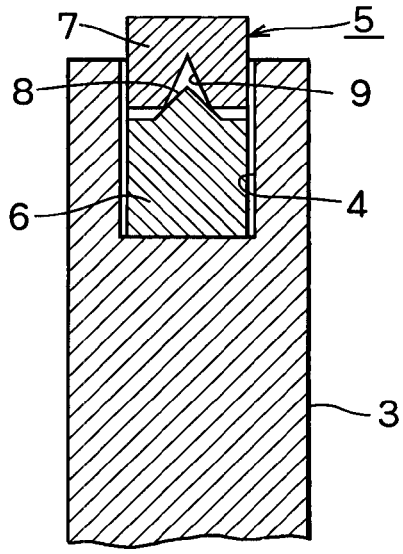
FIG. 4 is an enlarged vertical sectional view of the third embodiment of a tip seal according to the present invention.

As shown in FIG. 4 relating to the third embodiment of the present invention, an engagement projection 8 is formed on a backup material 6, while an engagement groove 9 is formed in a sealing material 7.

Figure 5:
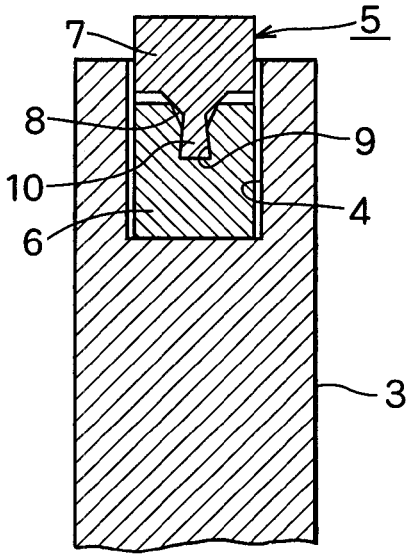
FIG. 5 is an enlarged vertical sectional view of the fourth embodiment of a tip seal according to the present invention.

FIG. 5 is the fourth embodiment of the present invention. An engaging portion 10 slightly wider at the end than the other parts of an engagement projection 8 of the sealing material 7 is formed and an engagement groove 9 of a backup material 6 is slightly wider at the bottom so as to fit the engaging portion 10 tightly.

Figure 6:
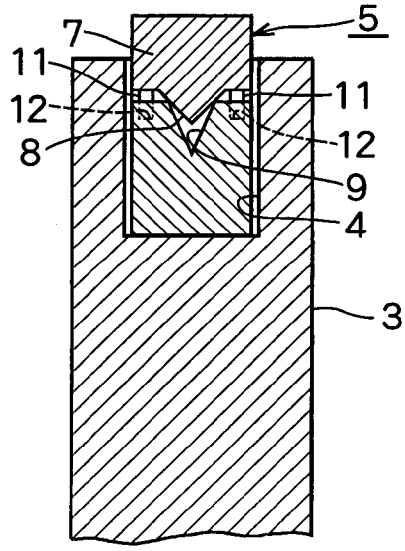
FIG. 6 is an enlarged vertical sectional view of the fifth embodiment of a tip seal according to the present invention.
Figure 7:
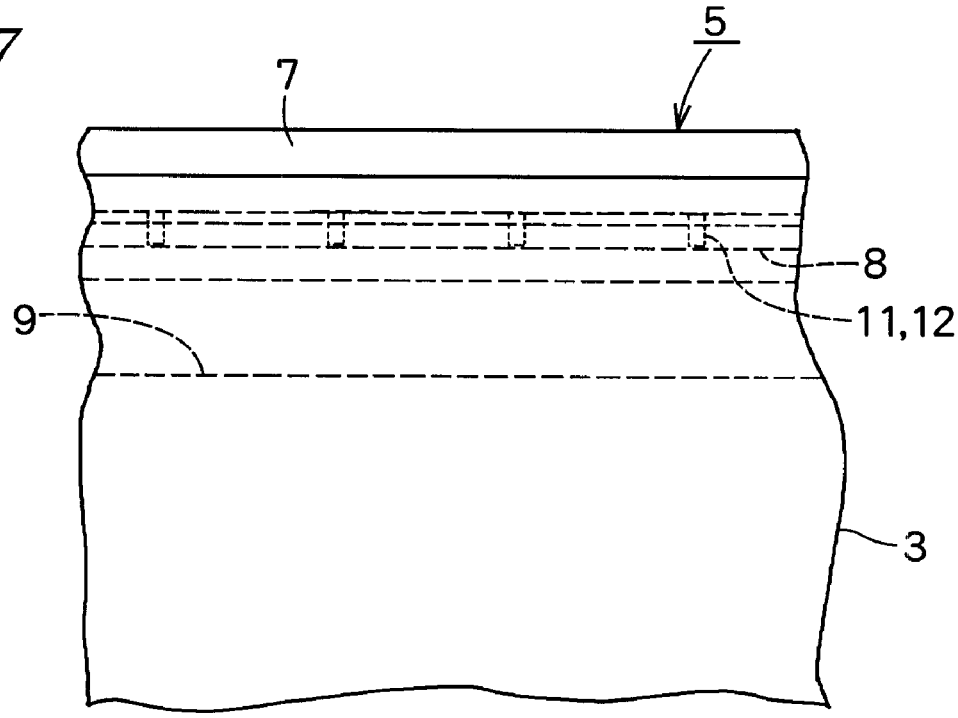
FIG. 7 is a side view showing one example of a protrusion and a hole in a tip seal according to the present invention.
Figure 8:
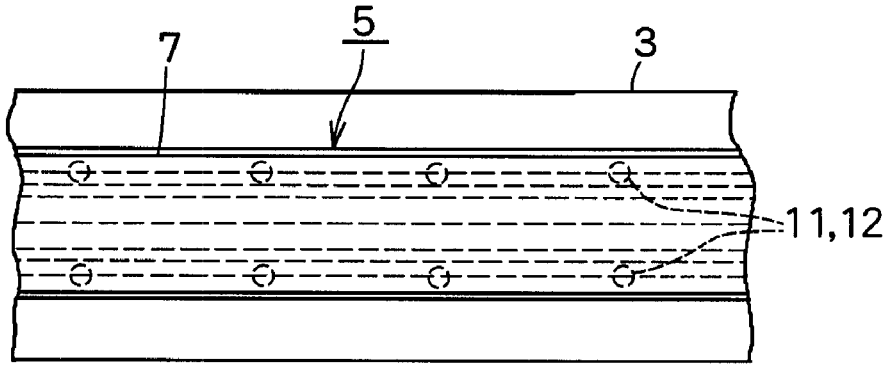
FIG. 8 is a side view showing another example of the protrusion and hole.

FIG. 6 shows the fifth embodiment of the present invention. A protrusion 11 and a hole 12 are formed at each side of an engagement projection 8 and engagement groove 9 of the sealing material 7 and backup material 6 respectively. The protrusion 11 and hole 12 may be continuous or comprise a plurality of separate ones in FIGS. 7 and 8 respectively.

The foregoing merely relate to embodiments of the invention. Various modifications and changes may be made by a person skilled in the art without departing from the scope of claims wherein:

What is claimed is:

1. A tip seal in a scroll fluid machine, comprising a stationary scroll having a stationary wrap and an orbiting scroll having an orbiting wrap, said tip seal comprising:

a sealing material in a tip-seal groove at an end of the stationary wrap and/or orbiting wrap to allow the stationary wrap to contact the orbiting wrap slidably; and a backup material between the sealing material and a bottom of the tip-seal groove, one of the sealing and backup materials having an engagement projection having a V-like cross-section, while the other has an engagement groove having a V-like cross-section to allow the engagement projection to fit in the engagement groove, wherein the V-like angle of the engagement groove is more acute than that of the engagement projection.

2. A tip seal in a scroll fluid machine, comprising a stationary scroll having a stationary wrap and an orbiting scroll having an orbiting wrap, said tip seal comprising:

a sealing material in a tip-seal groove at an end of the stationary wrap and/or orbiting wrap to allow the stationary wrap to contact the orbiting wrap slidably; and a backup material between the sealing material and a bottom of the tip-seal groove, one of the sealing and backup materials having an engagement projection having a V-like cross-section, while the other has an engagement groove having a V-like cross-section to allow the engagement projection to fit in the engagement groove, wherein a top end of the engagement projection and a bottom of the engagement groove are wider than the other parts of the engagement projection or engagement groove to allow the engagement projection to fit in the engagement groove tightly.

* * * * *